United States Patent [19]

Adkins

[11] 3,997,003

[45] Dec. 14, 1976

[54] TIME DELAY NIPPLE LOCATOR AND/OR DECELERATOR FOR PUMP DOWN WELL TOOL STRING OPERATIONS

[75] Inventor: Joel E. Adkins, Carrollton, Tex.

[73] Assignee: Otis Engineering Corporation, Dallas, Tex.

[22] Filed: June 9, 1975

[21] Appl. No.: 585,298

[52] U.S. Cl. ..... 166/113; 33/178 F; 166/255

[51] Int. Cl.[2] ..... E21B 47/00

[58] Field of Search ..... 166/65, 64, 113; 175/57; 33/178 F; 116/123; 73/151, 152

[56] References Cited

UNITED STATES PATENTS

| | | | |
|---|---|---|---|
| 2,590,233 | 3/1952 | Condra | 73/151 |
| 2,795,856 | 6/1957 | Reesby et al. | 33/178 F |
| 3,177,941 | 4/1965 | Conrad | 166/64 |
| 3,399,741 | 9/1968 | Monroe | 175/297 |
| 3,696,865 | 10/1972 | Chapman | 166/64 |

*Primary Examiner*—Ernest R. Purser
*Assistant Examiner*—William F. Pate, III
*Attorney, Agent, or Firm*—Warren H. Kintzinger

[57] ABSTRACT

A yieldable detent unit useful for pump-down well tool train operations that imparts a selected time delay from moment of unit engagement with a stop shoulder in a tubing run until the detent stop action is released, thereby causing a controlled duration fluid pressure increase pulse to be generated in the pump down system.

14 Claims, 2 Drawing Figures

Figure 1:
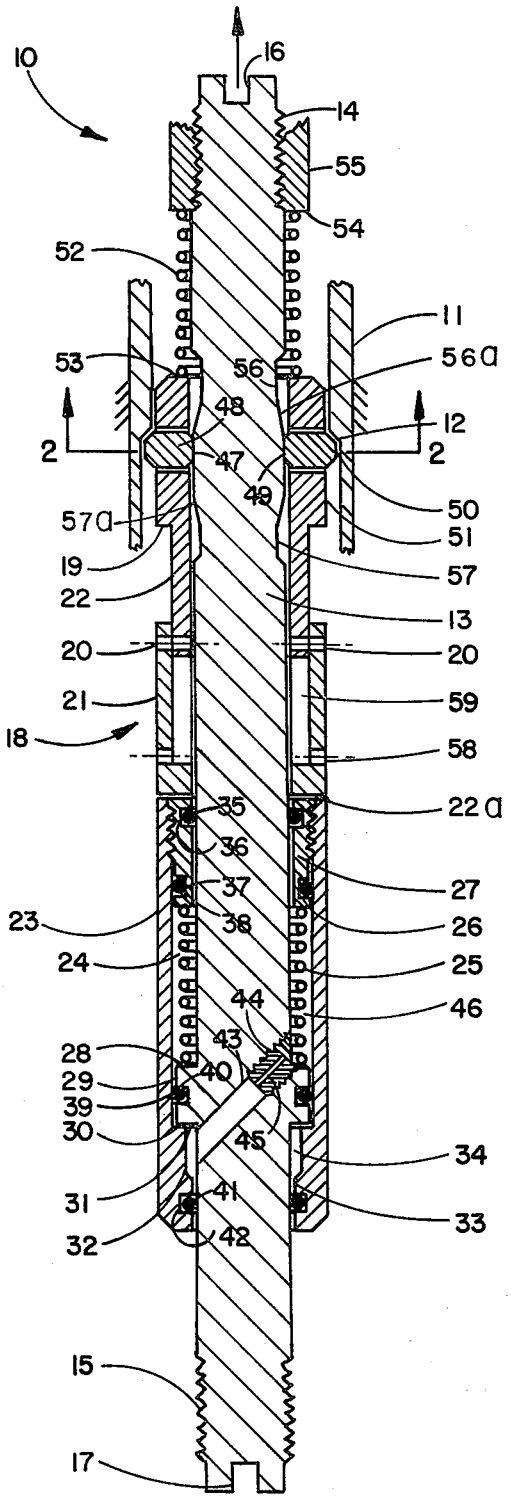

TIME DELAY NIPPLE LOCATOR AND/OR DECELERATOR FOR PUMP DOWN WELL TOOL STRING OPERATIONS

This invention relates in general to well tools, and in particular to an improved yieldable detent unit for use in pressure signal generation and as a fluid mass decelerator in pump down well tool operations.

Quite often in pump down operations it becomes necessary to know exactly where the train of well tools is located in the tubing string. In pump down operations, where a train of selectively sequenced, series-interconnected tools are positioned within a tubing string by differential fluid pressure imposed on respective terminating locomotive units of the tool train, location of the tool train within the tubing string is normally determined by metering the fluid in and out of the tubing string. Fluid metering is indicative of tool train location within the tubing string, as the volume within a tubing string, and/or tubing run (in the form of a flow conductor) defines a given volume of fluid in the closed system. Reference is made to U.S. Pat. No. 3,419,074, to N. F. Brown, assigned to the assignee of the present invention, wherein a detailed description of a pump down well operation is presented as it is useful in installation and operation of a gas lift system in a well. U.S. Pat. No. 3,419,074, describes a yieldable detent unit, or pressure signal generator unit, as employed in a tool train in a pump down operation wherein the engagement of the detent unit with certain cooperating collars, carried within the tubing string and/or on well tools such as valves installed within the string, causes a pressure increase pulse to be transmitted to the surface through the fluid, which may be recorded by a suitable pressure recording meter to provide intelligence concerning the position of the tool train within the tubing string.

A known form of landing nipple locator utilizes a snap ring, for example, to locate a nipple in the tubing run. This type of device operates on the principle of generating a pressure increase impulse as the locator passes a predetermined location in the tubing string, and—as all devices employing a yieldable detent for generation of a pressure increase pulse—has limitations, because the speed at which the nipple locator engages the nipple determines the pressure increase (if at all) when the tool string is moving rapidly within the tubing string.

It is therefore a principal object of this invention to provide a yieldable detent unit for pump down well tool train operations that imparts a time delay, as concerns the duration of a pressure increase pulse, when the unit passes a cooperating activating device in its passage through the tubing string.

Another object is to provide an improved yieldable detent device for use in a pump down tool train operation whereby tool train location may be pinpointed in relation to a critical point in a well tubing string, such as in, or on either side of, a tree.

A further object is to provide a yieldable detent pressure signal generator by means of which the detent is yieldably released after a preselected time delay from engagement of the device with a predetermined location within a well tubing string.

Still another object is to provide a yieldable detent device for use in pump down tool train positioning that may act as a decelerator to aid in more precisely controlling the movement and stopping the mass of fluid used in a pump down system.

Features of this invention useful in accomplishing the above objects include, in a yieldable detent well tool, first and second telescopical body sections with an annulus therebetween defining a first sealed-off, oil-filled, chamber. A small bypass port, of selected size, provides fluid communication between the first sealed-off chamber and a second sealed-off chamber defined by a further annulus between body sections. Internally contained spring means resists telescoping motion between the body sections and quiescently urges the sections into a relative position such that the fluid is forced into the first chamber. One of the body sections carries a dog cage within which radially displaceable dogs are confined and, in the quiescent relative positions of the body members, positioned radially outwardly so as to be engageable with a stop collar within the tubing string. Upon stop collar engagement, the dogs are constrained from moving radially inwardly to permit continued passage of the tool within the tubing string, until a sufficient fluid transfer from the first to the second sealed chamber permits telescoping action between body sections sufficient to align an annular groove formed about the inner body member with the radial inward extremes of the detent dogs, whereby the dogs may be cammed radially inwardly to release the detented engagement with the tubing string stop collar.

A specific embodiment representing what is presently regarded as the best mode for carrying out the invention is illustrated in the accompanying drawing.

Figure 2:
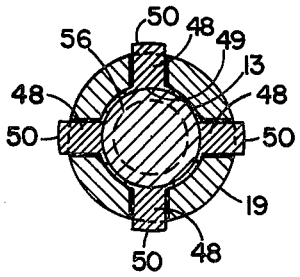

In the drawing:

FIG. 1 represents a side elevation, sectioned view of the yieldable detent unit useful as a time delay nipple locator and/or decelerator for pump down well tool string operations; and FIG. 2, a sectioned view taken along the line 2—2 of FIG. 1.

Referring to the drawing:

The detent unit 10 of FIG. 1 is shown as it would be included in a tool train driven by a pumping operation so as to be operational when the train is coming out of a well pipe string, as indicated by the directional arrow uppermost in the Figure. A portion 11 of a fixed landing nipple, or other well tool positioned in the tubing run, is shown with an inside diameter transition which forms a stop shoulder 12 against which the detent unit 10 operably engages as the unit is withdrawn from the well.

The detent unit 10 is constructed as a telescopical assembly comprising on inner cylindrical member 13 having externally threaded upper and lower ends 14 and 15 and through slots 16 and 17 to facilitate a threaded and pinned interconnection with tool train coupling members (not shown), by means of which the detent unit 10 is coupled in the tool train.

An outer body member 18 is carried concentrically about the inner body member 13 and is longitudinally displaceable with respect to the inner body member 13 between respective displacement limits. As depicted in FIG. 1, the outer body member 18 is positioned in a quiescent, spring loaded, and limit defined position on the inner body member 13.

As shown in FIG. 1, the outer body assembly 18 comprises a cylindrical dog cage member 19 fastened by shear pins 20 to a cylindrical shear sleeve member 21. Shear sleeve 21 is slideably received over the reduced outside diameter surface 22 of dog cage 19.

The lower depicted extreme of shear sleeve 21 is formed with a reduced inside diameter so as to be slideably receivable on the inner body member 13. The end surface 22a of shear sleeve 21 abutts the end surface of a fluid chamber defining sleeve member 23. Sleeve 23 is formed with a first section of inside diameter exceeding the outside diameter of inner body member 13, thus defining an annulus 24. A compression spring member 25 is confined within annulus 24 so as to impart a loading against the end 26, a sealing plug 27 threadedly received into the sleeve member 23, and a stop shoulder 28 defined by an annular enlarged-diameter portion 29 formed on inner body member 13, thus loading the stop shoulder 30 on inner body member 13 against a stop shoulder 31 formed by a further reduced inside diameter portion 32 of sleeve member 23.

A still further reduced inside diameter portion 33 of sleeve member 23 establishes a sliding concentric fit of sleeve 23 on inner body member 13, and forms a second annulus 34 between the inner body member 13 and outer sleeve member 23.

The aforedescribed annuli between inner body member 13 and outer sleeve member 23 are caused to define first and second sealed chambers by means of sealing O-rings. The uppermost depicted end of the chamber defined by annulus 24 is internally sealed to inner body member 13 by means of an O-ring 35 confined in the internal annular groove 36 in sealing plug 27, while external sealing against the inner-wall of sleeve member 23 is effected by an O-ring 37 confined in the external annular groove 38 in sealing plug 27.

The lower depicted end of the chamber defined by annulus 24, and the upper depicted end of the chamber defined by annulus 34, are sealed against one another and to the inner surface of sleeve member 23, by an O-ring 39 confined in the external annular groove 40 in the enlarged diameter portion 29 of inner body member 13.

The lower depicted end of the chamber defined by annulus 34 is sealed by means of O-ring 41 confined in the annular groove 42 formed in the inner surface of sleeve member 23.

A fluid communication between the above-defined sealed chambers is provided by a bypass port 43 formed through inner body member 13 and extended between chambers. A pipe plug 44, insertable in the port 43, may be formed with a selected diameter orifice 45 extended therethrough, thus providing a selected degree of restricted fluid communication between the chambers. The chamber defined by annulus 24 is filled with oil 46, prior to the sealing plug 27 being threaded into sleeve member 23.

The cylindrical dog cage member 19 of the outer body assembly 18 is formed with an inside diameter permitting a sliding fit over the outer surface of inner body member 13. In the quiescent condition depicted in FIG. 1 and FIG. 2, dog cage 19 is positioned with respect to the inner body member 13 such that the radial inward extremes 47 of symmetrical circumferentially disposed dogs 48 ride on a full outside diameter surface portion 49 of inner body member 13, with the radial outward extreme ends 50 of the dogs 48 extending outwardly from the outer surface 51 of the dog cage, and thus projecting beyond the outside diameter extreme of the detent assembly 10.

As depicted in FIG. 1, the detent assembly is completed by means of a further helical spring member 52 held in loaded confinement between the end extreme 53 of the dog cage 19 and the end shoulder 54 of a terminating member 55 threadedly received on the uppermost depicted end 14 of the inner body member.

With no force being longitudinally imparted between the outer body assembly 18 and the inner body member 13, the detent assembly assumes the spring loaded assembled relationship depicted in FIG. 1, with the radial inward extreme ends 47 of the dogs 48 riding on the full outside diameter portion 49 of inner body member 13. This full diameter portion 49 communicates via inclined camming surfaces **56*a* and 57*a* with respective annular grooves 56 and 57 formed in the outer surface of inner body member 13. The grooves 56 and 57 are of a depth sufficient to permit the dogs 48 to retract radially inwardly (when opposite the grooves) to cause the radial outward extreme ends 50 of the dogs to be flush with the outer surface of the sleeve assembly 18**.

With reverse movement of tool 10 as it is being poured with fluid into and through the tubing string, and dogs 48 encounter an upwardly facing shoulder (facing oppositely of shoulder 12, and not shown), the resistance of inner body member 13 prevents inward movement of the dogs 48 until they can retract into annular groove 56. This then permits the tool 10 to pass downwardly past such an upward facing shoulder obstruction in the well tubing string. Immediately after the dogs 48 move past the reduced diameter boss of such an upward facing shoulder obstruction spring 52 returns outer dog cage member 19 to its normal position on the inner body member 13 with dogs 48 again disposed in their outermost position, as shown in FIG. 1.

In operation, as the detent assembly herein described is withdrawn from a well, as indicated by the upward motion depicted in FIG. 1, and the dogs 48 contact a stop shoulder 12 on a nipple or other tool fixedly positioned in the tubing run through which the assembly passes, the continued force applied to move the assembly upwardly causes the dog cage to push against the oil filled sealed chamber defined by annulus 24, and the resulting pressure transfers the oil 46 through the orifice 45 and communicating port 43 into the other sealed chamber defined by annulus 34. The oil transfer is effected at a rate defined by the port orifice diameter, and the inner body member 13 moves up within the outer body member 18, over sufficient travel to permit the dogs 48 to cam down the inclined side cam wall **57*a* of annular groove 57 formed in inner body member 13, and allow the detent tool assembly 10 to pass by the stop shoulder 12. As the detent assembly moves further up the tubing run within which it passes, the spring member 25 within the chamber defined by annulus 24, that was compressibly loaded during the relative travel between the inner and outer body members, urges the assembly back into its quiescent relationship between inner and outer members, with the oil 46 being forced back into the larger sealed chamber defined by annulus 24**, thus relocating the dog cage and dogs to seek and locate another stopshoulder defined position in the tubing run through which the assembly passes.

To allow for emergency shear, should the detent assembly malfunction, the aforedescribed shear sleeve 21, positioned concentrically over the dog cage 19 and pinned thereto by shear pins 20, permits, upon the encounter of abnormal loading sufficient to shear the pins 20, a telescoping action between shear sleeve 21 and dog cage 19 which permits travel between dogs and inner body assembly 13 sufficient to permit dog retraction into annular groove 57 and thus permit the unit to pass by the obstruction. In the event that emergency shear is encountered, the shear sleeve 21 is provided with relief holes 58 to prevent any fluid that may be in the annulus 59 between shear sleeve 21 and inner body member 13 from being entrapped sufficiently to impede the desired rapid telescoping action between shear sleeve 21 and dog cage 19.

Should the detent assembly encounter the abnormal loading during travel down the tubing run, the resulting pin shear and telescoping action between shear sleeve and dog cage permits travel of inner body member 13, downward, relative to the outer body member, sufficient to permit dogs 48 to retract into annular grooves 56 in the inner body member and thus clear the abnormal force imparting obstruction.

As described herein, the detent assembly has been illustrated in FIG. 1 as positioned for locating nipples on the way out of the well. In order to locate nipples on the way into the well, the device may be mounted in inverted position in the tool string. In order to locate nipples both going into and coming out of the well, two of the units herein described may be employed in the tool string, with one being placed upside down in the string.

The device herein described is seen to effect a detent action upon encounter with a tubing string stop collar location. A fluid pressure increase pulse will then be initiated and held for a predetermined time interval as defined by the size of the bypass orifice between sealed fluid chambers. The delay action may be set as desired by inserting a pipe plug with selected orifice in the fluid bypass port between fluid chambers.

The device herein described may function as a decelerator, introducing a selected time delay by metering fluid through an orifice from one sealed chamber to another, as described hereinbefore, in the stopping and control of movement of a mass of fluid such as is used in pump down systems.

Whereas this invention is herein illustrated and described with respect to a particular embodiment thereof, it should be realized that various changes may be made without departing from essential contributions to the art made by the teachings hereof.

I claim:

1. A yieldable detent mechanism comprising first and second mutually telescopical cylindrical body members including an inner body member and an outer body member, the respective diameters of which define an annulus between said body members; spring loading means cooperatively engaging each of said body members to define a quiescent relative telescoped position therebetween; first and second slideable pressure sealing means between the inner and outer body members, at the respective longitudinal ends of said annulus; a further common sliding pressure sealing means between said body members and intermediate the longitudinal extremes of said annulus, to define first and second complementary pressure sealed chambers in said annulus; a restricted fluid communication means extending between said first and second pressure sealed chambers; and detent means carried by said outer body member and including radially retractable dog members, the radial extremes of which extend beyond the outside surface of said outer body member with said first and second body members in the quiescent relative position therebetween, having means to enable said dog members to be retractable radially inwardly upon a predetermined longitudinal travel of one body member with respect to the other of said body members being effected from the relative quiescent longitudinal positional relationship therebetween.

2. The yieldable detent mechanism of claim 1, wherein said detent means comprises a dog cage means affixed to one end of said outer member and extended concentrically about said inner body member, said plurality of dog members carried by said dog cage in symmetrically disposed positions about the periphery thereof, said dog members being slideably receivable through said dog cage and constrained to radial motion with respect thereto and transverse the longitudinal axis thereof, said inner body member being formed with at least one annular groove into which said plurality of dog members may radially retract upon said predetermined longitudinal travel of one body member with respect to the other body member being effected.

3. The mechanism of claim 2, with said dog members having inclined edge surfaces on the respective sides thereof which face the respective longitudinal extremes of said mechanism, and said annular groove in said inner body member being formed with respective inclined sides thereof to facilitate a camming interface between said dog members and said annular groove.

4. The mechanism of claim 3, with said fluid communication port comprising a bore through said inner body member, the ends of which communicate respectively with said first and second fluid chambers.

5. The mechanism of claim 4, wherein said common sliding pressure seal means comprises an enlarged diameter portion of said inner body member into which an annular groove is formed, with an O-ring compressibly held in said groove and in sliding, pressure sealing contact with the inner surface of said outside body member.

6. The mechanism of claim 5, wherein said fluid communication port is extended through said inner body member at an angle, with the respective port ends in communication with respective ones of said first and second fluid chambers on respective opposite sides of said enlarged diameter portion of said inner body member.

7. The mechanism of claim 6, with said fluid communication port having a pipe plug member inserted therein, with said pipe plug member having a selected diameter longitudinally extending opening formed therethrough to establish a selected restrictive orifice between said pressure sealed chambers.

8. The mechanism of claim 6, wherein said dog cage and outer body member are mutually coupled through a shear sleeve member, and shear sleeve member comprising a hollow cylindrical section with outside diameter like that of said outer body member and telescoped over a reduced diameter section of said dog cage member, with shear pin means extended through said shear sleeve and dog cage to effect a pinned connection therebetween.

9. The mechanism of claim 8, with a plurality of fluid relief holes extending through said shear sleeve into the annulus between said shear sleeve and said inner body member.

10. The mechanism of claim 8, wherein said inner body member is formed with first and second annular grooves either side of an intervening full diameter section of predetermined length, whereby a predetermined relative longitudinal travel between said body members either side of said quiescent mutual position effects radial placement between said dog members and a respective one of said annular grooves to thereby permit radial retraction of said dog members.

11. The mechanism of claim 10, wherein said quiescent relative position of said body members effects a spring loaded engagement between the end of the enlarged diameter portion of said inner body member and a stop shoulder extending radially inwardly from the inner surface of said outer body member, with said spring loading means comprising a first compression spring means confined between respective end walls of, and lying within the confines of, one of said pressure sealed chambers.

12. The mechanism of claim 11, wherein one end of said annuli between first and second body members is terminated by a hollow plug member slideably received over said inner body member and threadedly received into said outer body member; said plug member comprising sliding pressure sealing means between the inner surface thereof and the outer surface of said inner body member, and sliding pressure sealing means between the outside surface thereof and the inner surface of said outer body member; with said first compression spring means being confined between the inserted end of said plug member and the stop shoulder formed by the enlarged diameter transition of said inner body member.

13. The mechanism of claim 8, wherein said shear sleeve member is formed with an end wall through which said inner body member is slideably received, with said end wall abutting one end of said outer body member, and said spring loading means comprising a further compression spring confined between the end of said dog cage means and a further stop shoulder extending from the outer surface of said inner body member.

14. The mechanism of claim 13, wherein said pressure sealed fluid chambers are filled with oil.

* * * * *